United States Patent [19]

Birkeland

[11] Patent Number: 4,922,935

[45] Date of Patent: May 8, 1990

[54] DENTAL HYGIENE DEVICE

[75] Inventor: Robert L. Birkeland, Mound, Minn.

[73] Assignee: T. N. T. Medi Corporation, Mound, Minn.

[21] Appl. No.: 255,512

[22] Filed: Oct. 11, 1988

[51] Int. Cl.[5] ..... A45D 44/18

[52] U.S. Cl. ..... 132/309

[58] Field of Search ..... 132/309, 308, 310, 323, 132/324, 325, 328; 401/123, 125, 191; 206/581, 226, 823

[56] References Cited

U.S. PATENT DOCUMENTS

| | | | |
|---|---|---|---|
| 1,656,823 | 1/1928 | Katz et al. | 132/328 |
| 1,796,367 | 3/1931 | Grove | 132/309 |
| 2,233,522 | 3/1941 | Fickle | 132/309 |
| 3,908,678 | 9/1975 | Conn et al. | 132/325 |
| 4,294,269 | 10/1981 | Kyte | 132/309 |

*Primary Examiner*—Cary E. Stone

*Attorney, Agent, or Firm*—Kinney & Lange

[57] ABSTRACT

A dental hygiene device includes a housing for storing a toothbrush and tooth powder. The housing further includes a mechanism wherein the head of the toothbrush may be inserted and tooth powder is delivered to the bristles of the toothbrush. The housing also includes a storage reel mechanism for storing floss. A dental flossing tool is detachably attached to the housing along with a dental scraper tool.

17 Claims, 1 Drawing Sheet

DENTAL HYGIENE DEVICE

BACKGROUND OF THE INVENTION

The present invention relates to dental hygiene, and in particular, the present invention relates to a tool that is used for storing a toothbrush, tooth powder, dental floss and other dental tools.

With the increase in knowledge in dental hygiene, a number of dental hygiene practices have been developed and have grown in importance. For example, the importance of brushing teeth has been known and emphasized for some time. More recently, the use of dental floss has been emphasized. In addition, a dental tool for use in scraping teeth is also desirable. Soft rubber tips placed on tool help keep gums healthy by massage and picking between teeth.

For each of the above-mentioned dental hygiene practices, separate tools have been developed. Separate tools present storage problems. There is a need to have all the tools used for current dental hygiene practice such that they are storable together in a hygenic manner.

SUMMARY OF THE INVENTION

The present invention includes a dental hygiene device that includes a housing in which a toothbrush is immersed in a placque destroying liquid and an overlying housing in which tooth powder is stored. The housing further includes a mechanism wherein the head of the toothbrush may be inserted and tooth powder is delivered to the bristles of the toothbrush. The housing also includes a storage reel mechanism for storing dental floss. A dental flossing tool is detachably attached to the housing. In addition, a dental scraping tool is also detachably attached to the housing. Said scraping tool has two soft rubber tips for picking teeth and massaging gums which are removable and stored in housing.

DETAILED DESCRIPTION OF THE PREFERRED EMBODIMENTS

Figure 1:
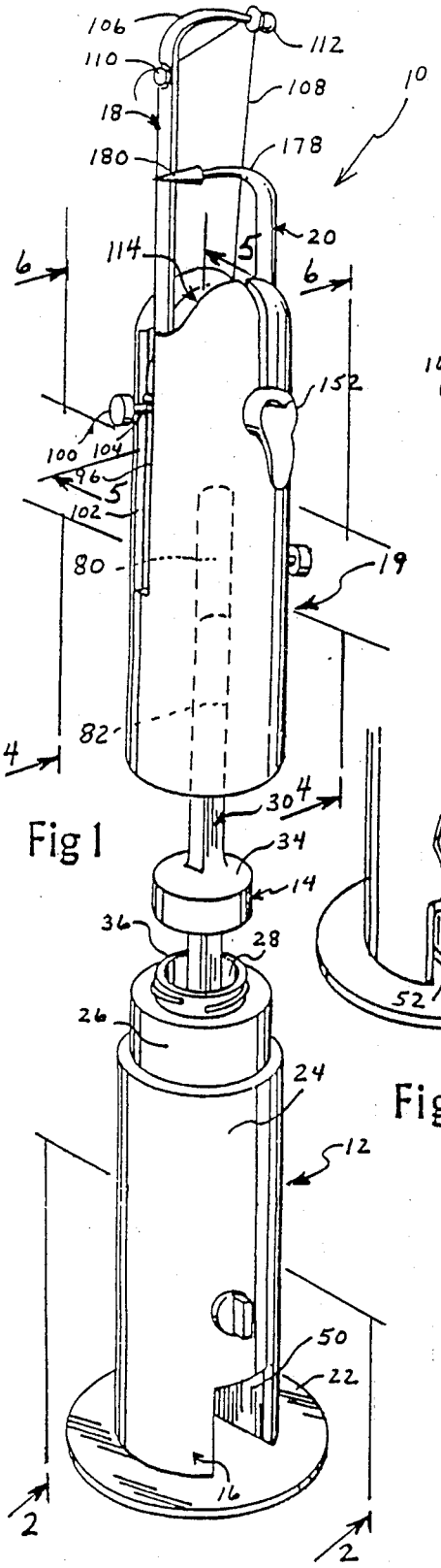
FIG. 1 is a perspective view of the device of the present invention.
Figure 6:
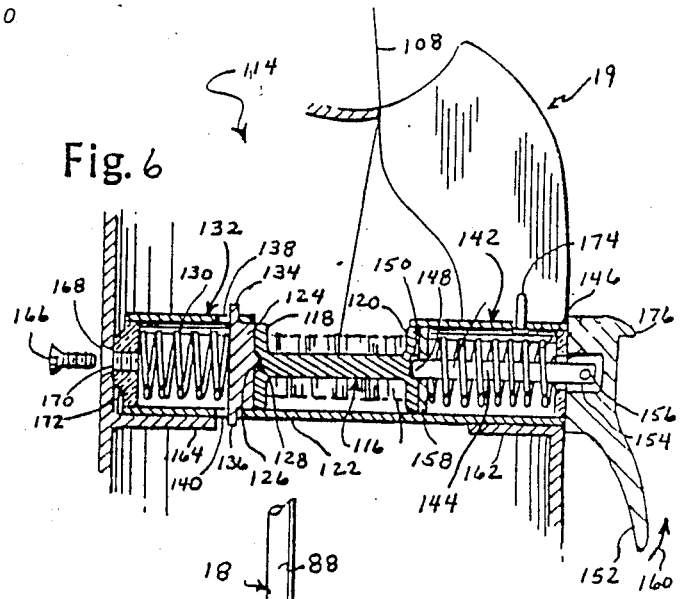
FIG. 6 is a sectional view taken along the line 6—6 in FIG. 1.

A dental hygiene unit of the present invention is generally indicated at 10 in FIG. 1. The dental hygiene unit includes a lower housing 12 for storage of a toothbrush 14 and for storage in a surrounding overlying housing 16 in the lower housing 12 tooth powder for use with a toothbrush. The unit further includes a flossing tool 19 and a dental tool 20 retained in an upper housing 19. The upper housing 19 is attachable to the lower housing 12. The hygiene device of the present invention includes all items for maintaining good dental hygiene.

The lower housing 12 includes a relatively flat annular base 22 onto which is attached a generally cylindrical housing member 24 having an upper reduced-indiameter cylindrical section 26 for mating with the upper housing 19.

The toothbrush 14 is housed in an inner chamber 28. The toothbrush 14 includes a handle section 30 and a head section 32. The handle section 30 includes a cap member 34 integral with the handle section 30. The cap member 34 threadably engages a threaded collar upper section 36 of the lower housing 12, providing a cap to seal the chamber 28.

The toothbrush head 32 includes bristles 38 extending on one side and an open cell foam section 40 disposed on an opposite side of the brush head 32. The open cell foam (sponge-like) is in fluid communication with the bristles providing moisture to the bristles when using the toothbrush. Mouth and tongue pressure on the foam section 40 releases moisture to the bristles. A liquid such as hydrogen peroxide is included in the chamber 28 and the toothbrush head 32 is stored in the liquid, keeping the bristles moist when not in use.

An outer chamber 42 is disposed between the outer cylindrical wall 24 and an inner cylindrical wall 44 which defines the inner chamber 28. The walls 24 and 44 are concentrically disposed with respect to each other. The outer chamber is used to store tooth powder. Access to the outer chamber 42 for replenishing tooth powder is provided by a screw plug 46 which threadably engages a threaded aperture 48 in the outer wall 24. A toothbrush access chamber 50 is provided in the lower portion of the lower housing 12. The chamber 50 is positioned directly adjacent a top surface of the base 22 and extends past the outer wall 24 at least past a central axis of the lower housing 12.

A tooth powder supply bin 52 is disposed directly above the access chamber 50 and directly below the inner chamber 28. An inner wall 54 separates the tooth powder supply bin 52 from the inner chamber 28. Tooth powder is supplied to the bin 52 through arcuate access openings 56 that are circumferentially disposed in a lower portion of the inner wall 44. A floor 60 of the bin 52 is concave in shape with an aperture 58 disposed at a central point of the floor 60.

A sliding L-shaped door 62 is slidable in the general direction indicated by arrows 64. The door 62 has an aperture 66 on an upper horizontal leg 68. The door 62 also has a substantially vertical lower leg 70 which is biased by a spring 72 disposed between a wall 74 and the lower leg 70.

Figure 3:
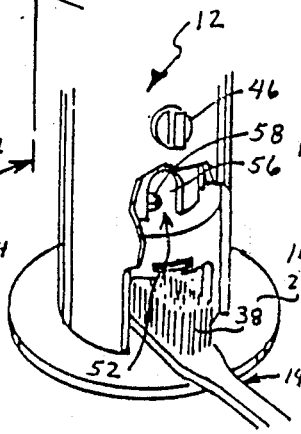
FIG. 3 is a perspective view with portions broken away of the lower portion of the lower housing 12.
Figure 5:
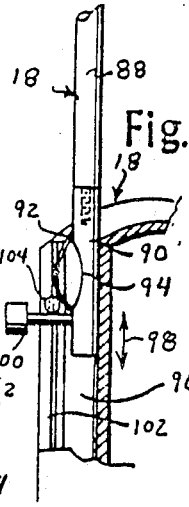
FIG. 5 is a sectional view taken along the line 5—5 in FIG. 1.

The upper leg 68 of the door 62 rides in a track 76. When a toothbrush head is placed within the chamber 50, as best illustrated in FIG. 3, the toothbrush head pushes against the lower leg 70 of the door 62 and aligns the aperture 66 with the aperture 58 permitting toothbrush powder to fall through the aligned apertures onto the bristles 38. The concave floor 60 aids in supplying powder to the toothbrush since the slope of the floor causes flow of powder towards the center of the bin 52 into the aligned apertures 58 and 66. When the toothbrush head is removed, the spring 72 will act against the lower leg 70 of the door 62 to place the aperture 66 in a non-aligning position with respect to the aperture 58 so that no more tooth powder falls into the chamber 50.

The upper housing 19 includes an inner chamber 80 which accepts a lower handle portion 82 of the toothbrush 14. When the toothbrush head is placed within the chamber 28 and the cap member 34 is attached to the threaded collar 36 of the lower housing unit 12. The upper housing unit 19 includes a lower chamber 84 defined by a lower cylindrical wall member 86 that mates with the reduced diameter portion 26 of the lower housing 12 when the upper housing is attached thereto.

A flossing tool 18 and dental scraping tool 20 are retained in the upper housing each in a substantially similar fashion so that the following description while referring only to the dental flossing tool 18, is understood to include the dental scraping tool 20.

The tool 18 includes an upper shaft portion 88 threadably attached to a base member 90. A flat bar spring 92 is attached to the base member at both ends and is curved outwardly. The flat bar spring 92 is attached over a concave depression 94.

The base member 90 is disposed in a well 96 and is movable within the well 96 in the general direction indicated by arrows 98. A pin handle member 100 extends from the exterior of the upper housing 19 inwardly into the well 96 and is fixedly attached to the base member 90. A stop bar 104 is attached to the upper housing at both ends running across the slot 102 and an upper portion of the slot 102. When not in use, the dental flossing tool 18 is moved downwardly with the base member 90 being disposed at a lower end of the well 96. When the dental floss tool is to be used, the tool is pulled up until the handle member 18 hits the stop bar 104. The bar spring 92 will act against the bar stop 104 to hold the dental flossing tool in an extended position.

It will be appreciated, that the dental flossing tool 18 and the dental scraping tool may be detached from the base members with the base members being switched. The upper housing 19 is used as a handle in using the tools 18 and 20.

The dental floss tool 18, illustrated in FIG. 1, includes an upper portion 106 that is gently curved in a 90° angle. Floss 108 is tautly secured at one end on a button stem 110. The button stem 110 is fixedly attached to the floss tool 18 below the curved portion 106. At the end of the curve portion 106, is attached a removable soft blunt tip 112 around which the floss is wound.

The upper housing 19 includes a floss storage chamber 114 at an upper end portion. A supply of floss 108 is disposed about a floss storage reel 116 that is rotatably secured within the housing 114. The floss storage reel 116 includes end flanges 118 and 120. The floss reel 116 is disposed within a housing tube 122. The housing tube 122 is half-cylindrical in configuration, that is, the upper half of the housing tube is open so that the floss storage reel is removable and so that floss may be removed from the storage reel. The housing tube and the storage reel are disposed diametrically opposite to the dental tool wells of the tools 18 and 20.

Storage reel 116 is rotatably attached to a flange member 124. The flange member 124 has a protrusion 126 that engages a depression 128 in the flange 118. The flange 124 is biased towards the storage reel by a spring 130. The spring 130 is in a compressive state within a housing tube compartment 132. The flange 124 includes upper and lower tabs 134 and 136, respectively, which ride within the slots 138, 140, respectively. As will be appreciated, the spring 130 biases the flange 124 against the floss storage reel 116.

A locking mechanism 142 prevents the storage reel 116 from rotating by engaging the flange 120. The locking mechanism 142 includes a bar 144, rectangular in cross section, biased towards the flange 120 by a spring 146. The bar 144 at a distal end 148 engages a rectangular depression 150 in flange 120. The bar 144 is secured to a lever arm 152 at a proximal end 154 by a pin 156. A retaining wall 158 is fixedly attached to the bar 144 at the distal end 148 such that a portion of the distal end 148 extends past the wall 158 to engage the flange 120.

When the lever 152 is in the position as illustrated, the distal end 148 of the bar engages the flange 120 preventing the storage reel from rotating. When the lever 158 is pulled in the direction of arrow 160, wall 158 compresses the spring 146 and distal end of the bar 148 is disengaged from the flange 120, permitting the storage reel 116 to rotate. (The bar 144 extends through an aperture in the housing wall).

The housing tube 122 rests on shelves 162 and 164 that extend inwardly from the housing wall of the upper housing 19. The housing tube 122 is secured at an end opposite the lever 152 by a screw 166 extending through an aperture in the housing aperture 168 in the housing wall of the upper housing 19, engaging a threaded aperture 170 of a flange 172 of the housing tube 122. A pin 174 prevents the housing tube 122 from rotating.

The lever 152 also includes a cutting edge 176 useful for cutting the floss 108.

The tool 20 includes an upper gently curved portion 178, that is curved approximately 90°. At a distal end of the portion 178 is superimposed a pointed rubber tip 180 that is used for picking teeth. Also a conical rubber tip for massaging the gums can be superimposed on scraper.

Figure 4:
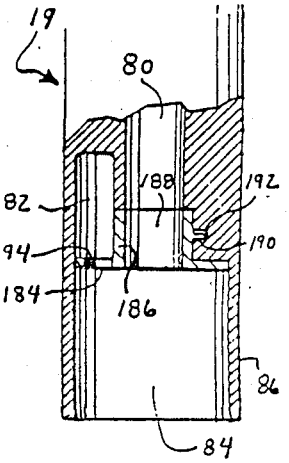
FIG. 4 is a sectional view taken along the line 4—4 in FIG. 1.
Figure 2:
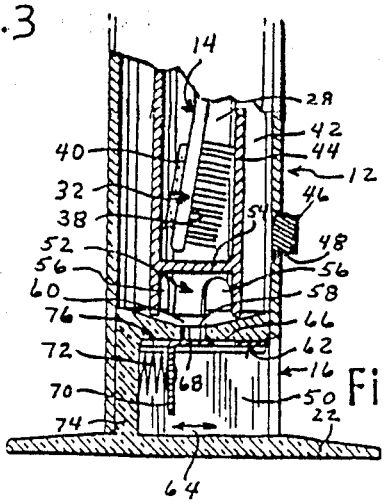
FIG. 2 is a sectional view taken along the line 2—2 in FIG. 1.

Referring back to FIG. 4, the upper housing 19 further includes a storage chamber 182 for holding extra tips 180. An annular flange 184 is rotatably secured to the housing 19 and acts as a door to the storage chamber 182. The flange 184 includes a collaar portion 186 that has a bore 188 in alignment with the chamber 80. The collar 186 is held in rotatable cooperation within the housing by a pin member 190 riding within a slot 192 in the housing. The flange 184 includes an aperture 194 which when aligned with the storage chamber 182 provides access thereto. The bore 188 permits the handle of the toothbrush to extend into the chamber 80, as discussed previously.

Although the present invention has been described with reference to preferred embodiments, workers skilled in the art will recognize that changes may be made in form and detail without departing from the spirit and scope of the invention.

What is claimed is:

1. A dental hygiene device comprising:

a housing;

first chamber means for storing a toothbrush within the housing;

second chamber means for storing tooth powder within the housing;

means for delivering tooth powder from the second chamber means to the toothbrush including an access opening within the housing and door means engagable by a head of the toothbrush such that when the door means is engaged, tooth powder falls on bristles of the toothbrush;

means for storing dental floss within the housing; and flossing tool means detachably attached to the housing.

2. The device of claim 1 and further including dental scraper means detachable attached to the housing.

3. The device of claim 2 wherein the dental scraper means is detachably attached to a first base member slidably attached to the housing.

4. The device of claim 3 wherein the flossing tool means is detachably attached to a second base member slidably attached to the housing.

5. The device of claim 4 wherein the dental scraper means and the flossing tool means are detachably attached either to the first base member or the second base member.

6. The device of claim 1 wherein the means for delivering tooth powder to a toothbrush further includes a tooth powder delivery bin in flow communication with the second chamber means for storing tooth powder such that tooth powder flows from the second chamber means to the delivery bin, and wherein the delivery bin includes a concave floor with an aperture positioned approximately in the center thereof such that when the door means is open, tooth powder flows through the aperture into the access opening onto the bristles.

7. The device of claim 1 wherein the housing includes a lower housing portion and an upper housing portion, the lower and upper housing portions detachably attached to each other.

8. The device of claim 7 wherein the means for storing floss and the flossing tool means are disposed in the upper housing portion and the first and second chamber means for storing and means for delivering tooth powder are disposed in the lower housing portion.

9. The device of claim 1 wherein the means for storing floss includes a storage reel rotatably attached within the housing such that floss may be removed from the reel.

10. The device of claim 9 and further including means for cutting floss, said means being attached to the housing.

11. The device of claim 9 and further including means for stopping and permitting rotation of the storage reel.

12. The device of claim 1 wherein the flossing tool means is detachably attached to a base memeber slidably positioned within the housing.

13. The device of claim 1 wherein the first chamber means includes hydrogen peroxide.

14. A dental hygiene device comprising:

a housing;

first chamber means for storing a toothbrush within the housing;

second chamber means for storing teeth powder within the housing;

means for delivering tooth powder from the second chamber means to the toothbrush;

means for storing dental floss within the housing; and flossing tool means detachably attached to a first base member slidably positioned within the housing.

15. The device of claim 14 wherein a dental scraper means is detachably attached to a second base member slidably attached to the housing.

16. The device of claim 14 wherein the dental scraper means and the flossing tool means are detachably attached either to the first base member or the second base member.

17. The device of claim 14 wherein the first chamber means includes hydrogen peroxide.

* * * * *

UNITED STATES PATENT AND TRADEMARK OFFICE

CERTIFICATE OF CORRECTION

PATENT NO. : 4,922,935

DATED : May 8, 1990

INVENTOR(S) : Robert L. Birkeland

It is certified that error appears in the above-identified patent and that said Letters Patent is hereby corrected as shown below:

Column 6, line 7, delete "memeber" and insert --member--.

Signed and Sealed this

Twenty-ninth Day of October, 1991

*Attest:*

HARRY F. MANBECK, JR.

*Attesting Officer*

*Commissioner of Patents and Trademarks*